US007985934B2

(12) United States Patent
Schuck et al.

(10) Patent No.: US 7,985,934 B2
(45) Date of Patent: Jul. 26, 2011

(54) CLOTHES DRYER

(75) Inventors: Rolf Schuck, New Bern, NC (US); Manfred Schulz, Berlin (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 844 days.

(21) Appl. No.: 11/919,259

(22) PCT Filed: Feb. 22, 2006

(86) PCT No.: PCT/EP2006/060170

§ 371 (c)(1), (2), (4) Date: Oct. 24, 2007

(87) PCT Pub. No.: WO2006/120046

PCT Pub. Date: Nov. 16, 2006

(65) Prior Publication Data

US 2010/0218394 A1 Sep. 2, 2010

(30) Foreign Application Priority Data

May 13, 2005 (DE) ..... 10 2005 022 353

(51) Int. Cl.
*H01H 27/06* (2006.01)

(52) U.S. Cl. ..... 200/61.68

(58) Field of Classification Search ..... 200/61.68, 200/61.81, 61.82
See application file for complete search history.

(56) References Cited

U.S. PATENT DOCUMENTS

| | | | | |
|---|---|---|---|---|
| 3,924,085 | A | 12/1975 | Stone | |
| 4,053,992 | A * | 10/1977 | Furgal | 34/60 |
| 4,687,889 | A * | 8/1987 | Leger | 200/61.62 |
| 5,728,985 | A * | 3/1998 | Hapke et al. | 200/61.62 |
| 2004/0134239 | A1 | 7/2004 | Hapke et al. | |

FOREIGN PATENT DOCUMENTS

| | | |
|---|---|---|
| DE | 6805497 U | 3/1969 |
| DE | 77 37 992 U | 6/1978 |
| DE | 28 29 991 | 6/1979 |
| EP | 1 134 316 | 9/2001 |
| GB | 1 567 591 | 5/1980 |
| GB | 2 133 455 | 7/1984 |
| WO | WO 2005/073453 | 8/2005 |

OTHER PUBLICATIONS

International Search Report PCT/EP2006/060170.

* cited by examiner

*Primary Examiner* — Renee S Luebke
*Assistant Examiner* — Lheiren Mae Caroc
(74) *Attorney, Agent, or Firm* — James E. Howard; Andre Pallapies

(57) ABSTRACT

A front-loading clothes dryer, a horizontally pivotable door is secured in its closed position against accidentally opening by a latching closure. Moreover, the door is connected to a safety switch which cuts off or re-establishes power supply for the clothes dryer depending on whether the door is in the open or in the closed position. The object of the invention is to ensure that the switching function remains matched over the long term to the closure state of the door, as when the clothes dryer was manufactured. For that purpose, the functional elements for the latching closure and safety switch are arranged in direct proximity to each other but functionally separated into a component arranged on the door and a component arranged on the casing.

11 Claims, 5 Drawing Sheets

CLOTHES DRYER

The invention emanates from a clothes dryer with a drying space accessible through a loading opening arranged in the front wall of a housing having a pull-open catch for a door of the loading opening, and having a safety switching device, which interrupts the operating voltage for the clothes dryer when the door is opened. The door, which is attached on one side to the unit housing and which can be pivoted in the horizontal plane, is secured in the closed position against accidental opening, the safety switching device interrupting or switching on the power supply for the clothes dryer depending on the open or closed position of the door.

BACKGROUND OF THE INVENTION

A pull-open locking device for doors of electrical domestic appliances, in which the safety circuit is mechanically in direct active contact with the locking device, is described in DE 33 01 636 C2. With this is known device, a pivoting forked latch, which can be brought into a stable open or closed position by means of a bolt permanently fixed in the unit housing when the door is opened and closed, is arranged in the door. The movement of the forked latch is transmitted in the manner of a toggle joint via a spring-loaded push rod to a plunger, which actuates a switch located in the electrical circuit of the domestic appliance. The functional elements of this combined locking and safety circuit are adjusted so that, when opening the door, the mains circuit of the unit is interrupted when the balance point of the toggle joint is overcome by the pulling-open movement.

The locking device is accommodated pre-mounted in a lock housing, which is set into a carrier plate in the door.

Devices of the kind described in which the safety circuit is mechanically coupled to the pull-open door catch have not become established in practice due to their susceptibility to failure. Devices have become known in a multitude of different embodiments in which the door catch and the safety circuit for the mains voltage are functionally separate from one another. A variant of a solution, which is frequently encountered in practice, provides that the switching circuit is actuated by a spring-loaded plunger, which protrudes from the front wall of the domestic appliance when the door is in the open position and which is pressed inwards by the door frame when the door is closed. The plunger is usually centrally arranged in the top part of the loading opening and therefore also spatially separate from the door catch. It is also known to arrange the plunger fixed to the door frame.

Associated with this arrangement of the plunger is the advantage that, in the event of a possible change of door hinging, the switching device works in the same way for both hinging possibilities without modification work.

Locking and switching device are adjusted so that the switching contacts of an interrupt switch located in the mains circuit of the unit are closed in the closed position of the door, and these open due to the effect of spring pressure when the door frame is lifted away from the closed position by a pulling-open movement and releases the plunger.

In the course of time, the door can warp, possibly through ageing or through improper use of the domestic appliance. It is then disadvantageous that the adjustment made by the manufacturer of the unit between the locking and switching device is lost and, as a result of this, faults can occur in the safety circuit. The switch contacts are then namely no longer able to close reliably when the door is closed, for example, or at best the power supply for the unit is only interrupted with a delay when the door is opened.

SUMMARY OF THE INVENTION

The object of the invention is to specify a solution for a clothes dryer of the kind mentioned in the introduction, which is constructively improved compared with the prior art, by means of which the adjustment between the locking device and the safety switch is permanently maintained, even when the spatial separation of the components is maintained. Furthermore, it is the object of the invention to restrict the number of individual parts required for manufacturing the device according to the invention to a minimum, in order to reduce the expense of stockholding and of assembling the clothes dryer.

According to the invention, the object is achieved by the features described herein. Advantageous embodiments of the invention can be seen from the following exemplary embodiments, the features of which can be combined with one another in any manner without departing from the idea according to the invention.

According to the invention, the safety switching device is arranged functionally separately from the locking device in spatial proximity thereto. Preferably, the locking bracket and the bolt are arranged in one piece on a carrier part and made from solid plastic. The functional parts of the locking device and the switching device are likewise integrated into a combination module on the housing side so that only one assembly has to be mounted in the unit housing and in the door frame respectively when the clothes dryer is manufactured.

Due to the spatial proximity of the locking device and the safety circuit and their arrangement in common modules, it is guaranteed that the adjustment of the switch function dependent upon the closed state of the door, which is made when the clothes dryer manufactured, is permanently maintained. A warping of the door—possibly due to the effects of ageing or improper use of the clothes dryer—has no effect on the trouble-free operation of the locking and safety switching device designed according to the invention.

The functional parts of the locking and safety switching device are constructively brought together in a door-side and a housing-side module so that only two individual parts have to be fitted during the manufacturing process of the clothes dryer. In a preferred embodiment, in an arrangement of the invention, provision is made to use the screws used for fitting the door and for joining the end plate and front wall as a fixing means. The number of individual parts to be held in the stores and the assembly effort when fitting the modules according to the invention are therefore reduced to a minimum. Compared with known devices, the invention incorporates a solution, which is economically very favorable.

BRIEF DESCRIPTION OF THE DRAWINGS

The invention and its possible advantageous embodiments are described in more detail below using a preferred embodiment of a clothes dryer as an example with reference to the drawings listed below. In the drawings

DETAILED DESCRIPTION OF THE EXEMPLARY EMBODIMENTS OF THE PRESENT INVENTION

Figure 1:
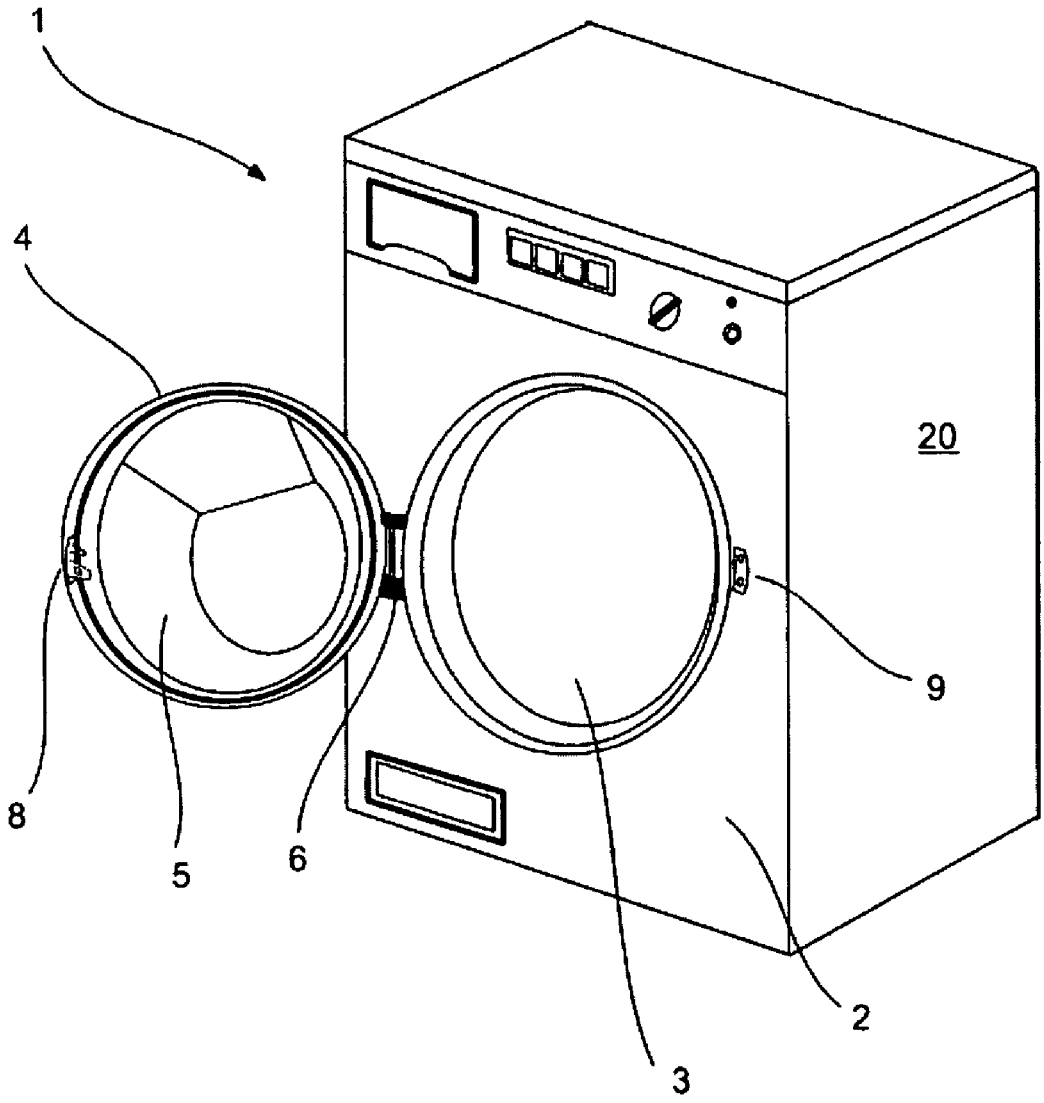
FIG. 1 shows a clothes dryer with front loading opening.
Figure 2:
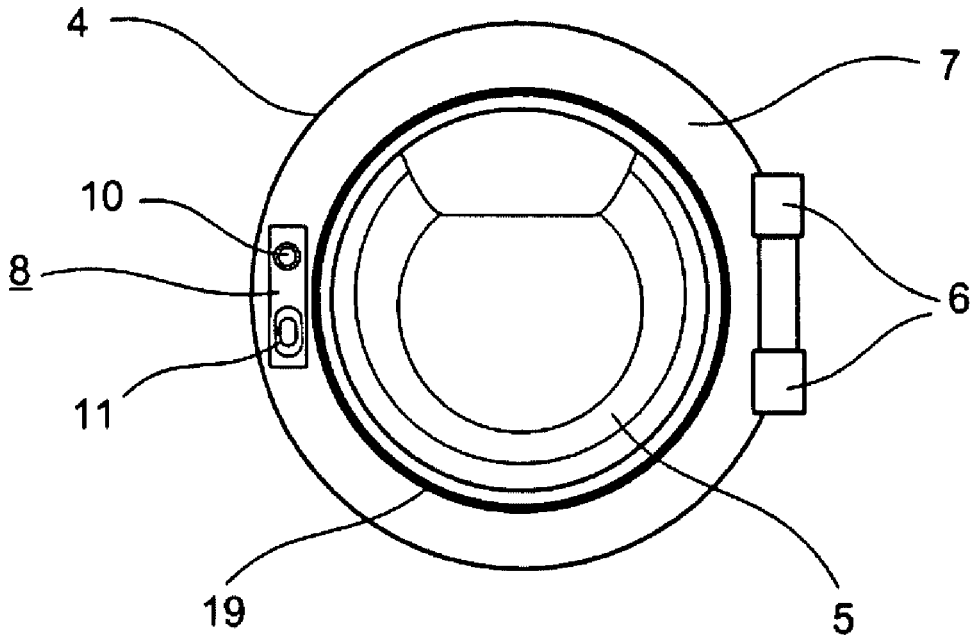
FIG. 2 shows a door viewed from the drying space.
Figure 3:
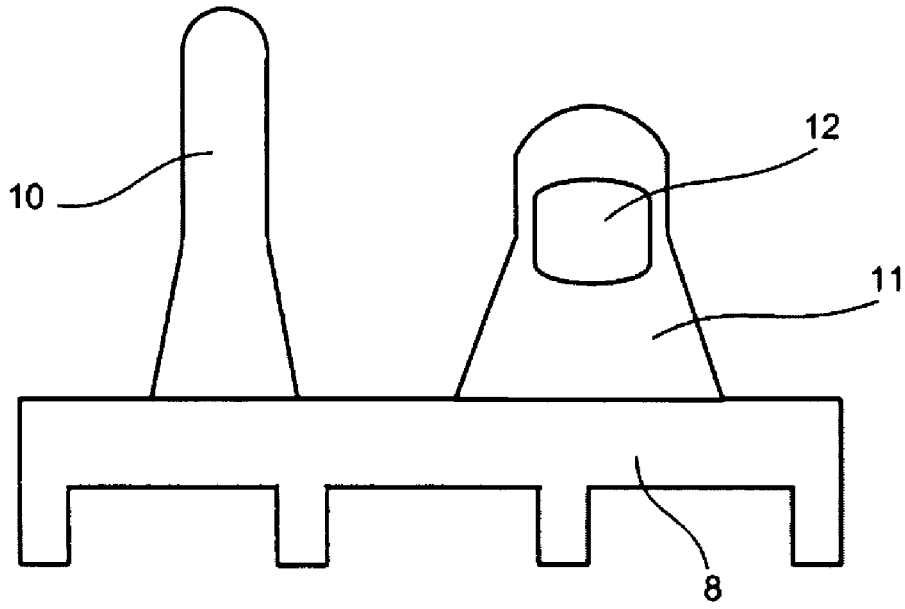
FIG. 3 shows a side view of a door-side carrier module.
Figure 4:
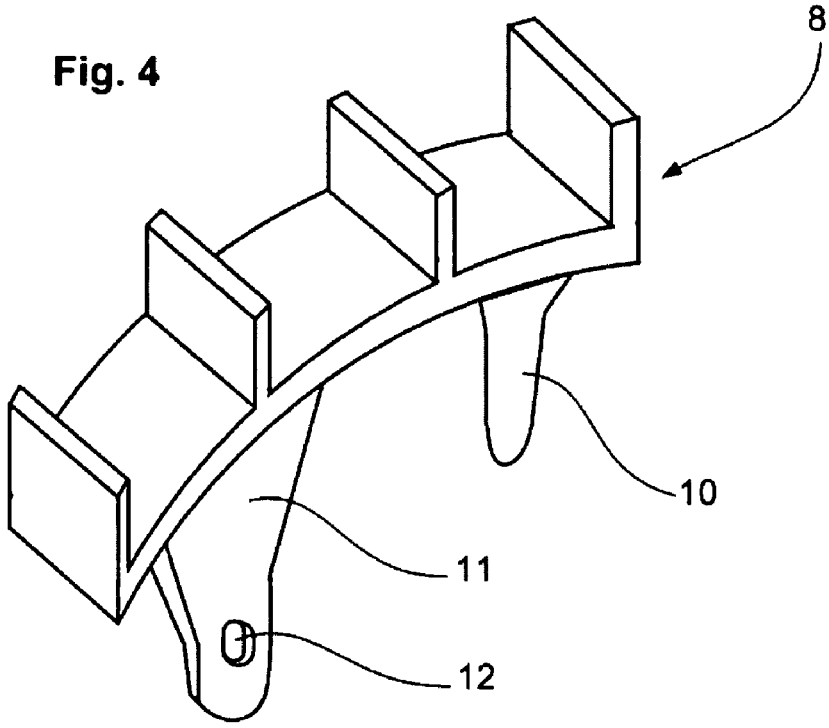
FIG. 4 shows a perspective view of the door-side carrier module.

A front-loadable clothes dryer 1 is shown in a preferred embodiment in FIG. 1. The loading opening 3 of the clothes dryer 1 can be closed with a door 4, which is attached to the unit housing by means of a hinge 6. The door 4 consists of a two-part plastic frame 7 with peripheral seal 19 and a fitted clear-view screen 5, which is held by the parts of the frame, which are screwed to one another.

The locking device for the door 4 contains a known pull-open catch, with which the door 4 is opened outwards by means of a firm pull. The likewise known safety switching device is arranged functionally separately from the locking device in immediate spatial proximity thereto. The functional parts for both devices are incorporated in a door-side (8) and a unit-side module 9.

The locking bracket 11 for locking the door 4 and the bolt 10 for actuating the safety switching device are arranged on a common carrier module 8 on the door 4 opposite the hinge 6. This door-side carrier module 8 is made in one piece together with the locking bracket 11 and the bolt 10 from a reinforced plastic.

During the assembly of the door 4, the carrier module 8 is placed in an accurately fitting seating formed in the door frame 7 and clamped in position by screwing the frame parts. Screwing ensures that the clear-view screen 5 held in the frame 7 is seated securely. As no further screws or other fixing means are specially required for stably retaining the carrier module 8 in the door frame 7, neither must any additional extra effort be expended during assembly.

Figure 5:
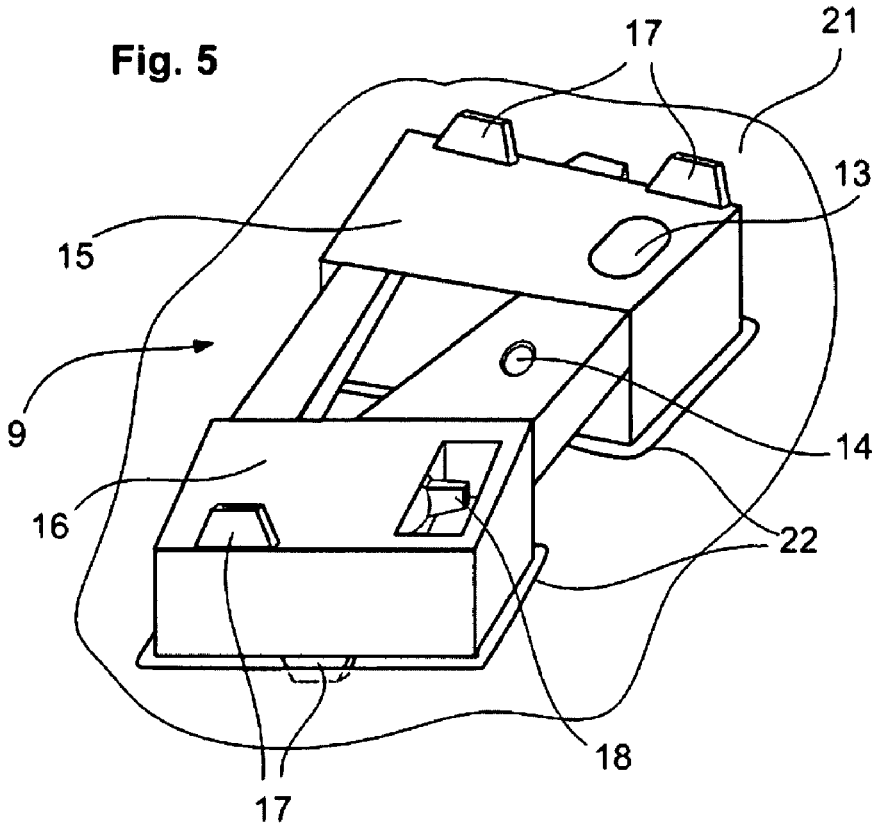
FIG. 5 shows the unit-side combination module.
Figure 6:
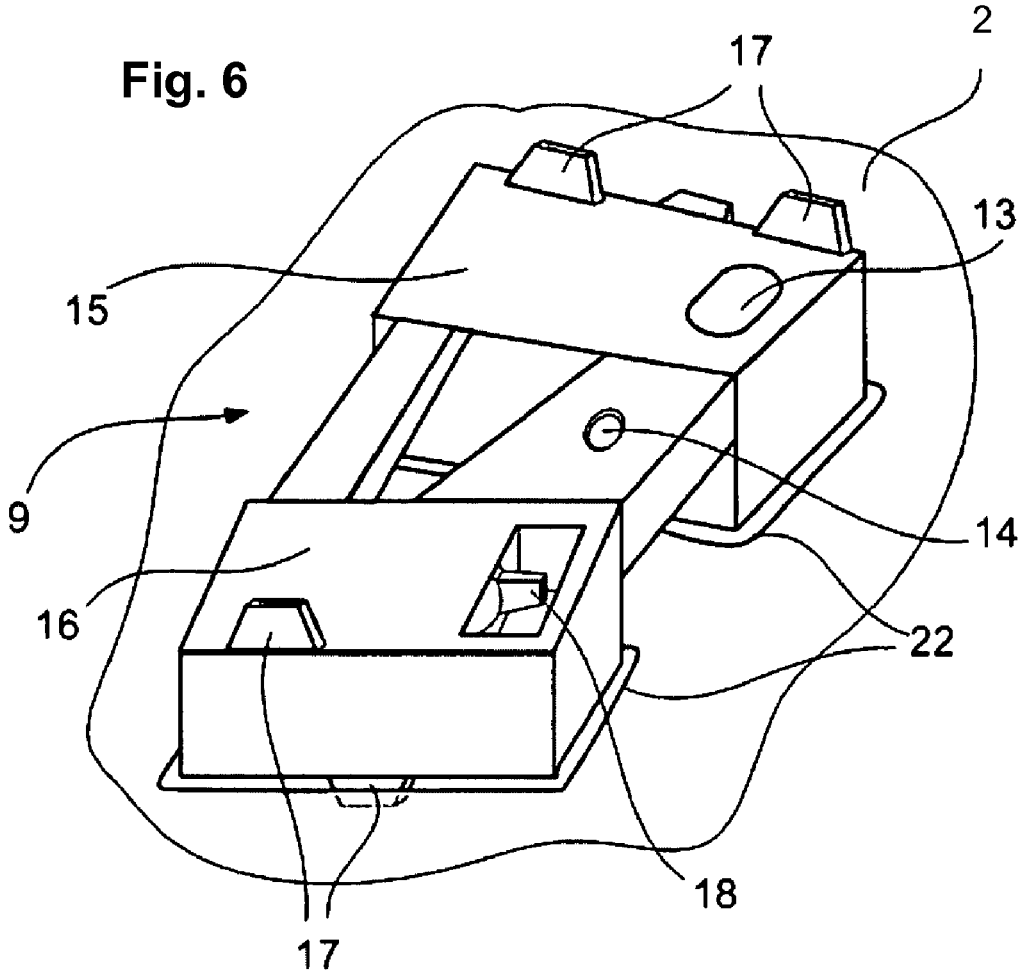
FIG. 6 exemplarily illustrates another embodiment of a unit-side combination module.
Figure 7A:
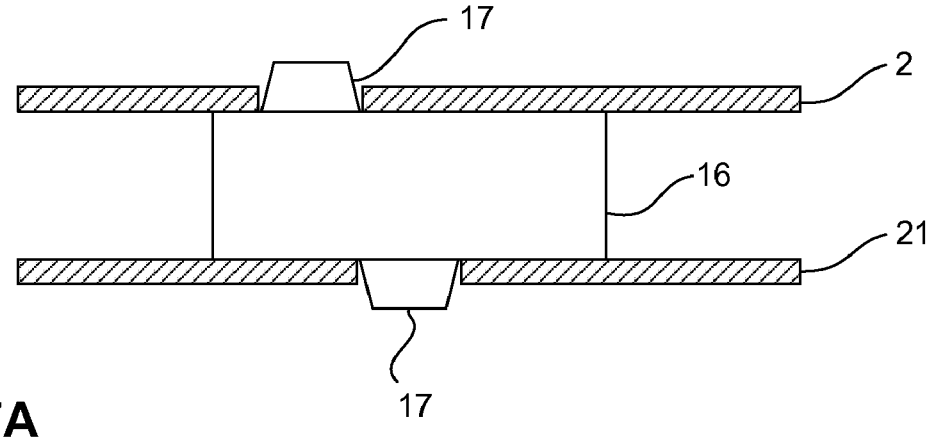
FIG. 7A exemplarily illustrates a cross section of the seating having a projection penetrating the end plate and parts of the front wall.
Figure 7B:
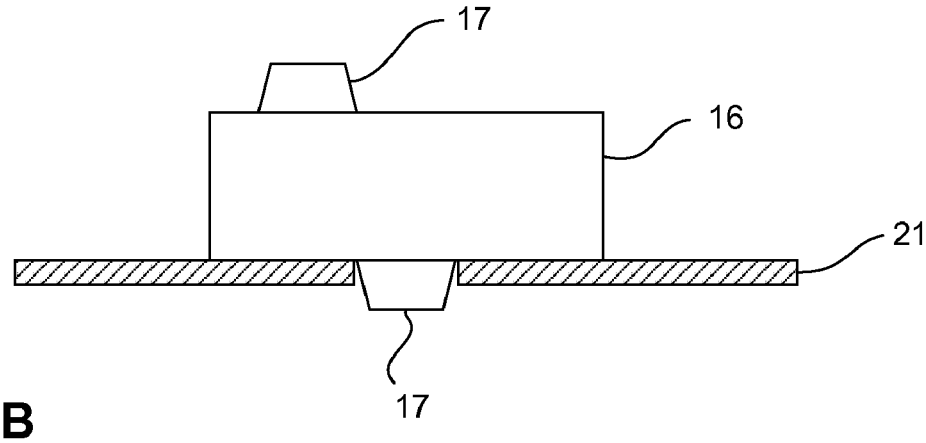
FIG. 7B exemplarily illustrates a cross section of the seating having a projection penetrating the end plate.
Figure 7C:
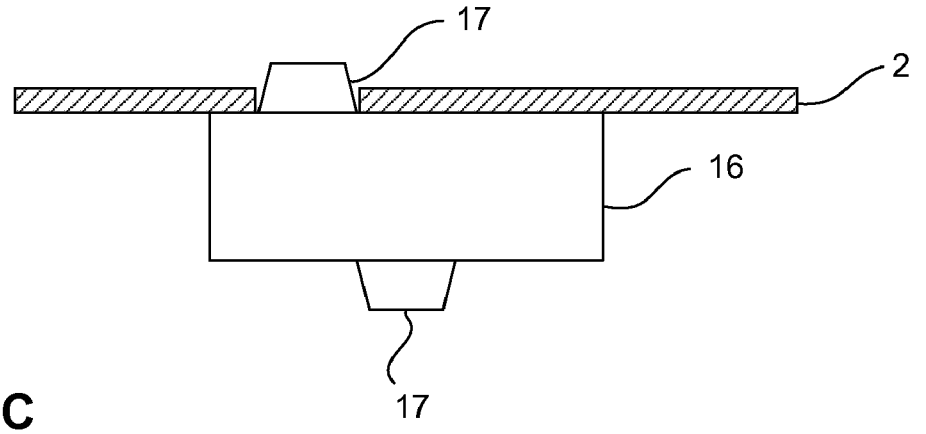
FIG. 7C exemplarily illustrates a cross section of the seating having a projection penetrating the front wall.

The door catch 16 and a housing 15 for accommodating the contact switch are integrated in the housing-side module 9 (FIG. 5). The module 9 has a plastic housing in which the parts placed therein are permanently positioned spatially and functionally separately from one another.

In order to safeguard against twisting or lateral offset, several projections 17 are molded onto the housing-side module 9 by means of which, on the one hand, the module 9 is supported on the front wall 2 or on the end plate 21, and on the other engages in appropriate recesses. By this means, the module 9 is securely positioned.

Instead of the projections 19 and recesses or in addition to these, the module 9 can be screwed by means of only one screw, which joins the end plate 21 to the front wall 2 of the clothes dryer 1 at this point. For this purpose, a screw hole 14 is provided in the module 9 roughly centrally between the seating 16 for the locking device and the switch housing 15.

Overall, the manufacture of the invention involves minimum effort.

The locking bracket 11 has a window-like opening 12 in which the rotatable cam 18 engages when the door is closed. Under the action of spring force, the cam 18 can adopt two stable positions, which are determined by a front and rear stop. When the door 4 is opened or closed, a spring force must be overcome up to a balance point, which spring force then automatically pushes the cam 18 into the opposite position. The pull-open catch is designed so that the force to be applied when opening the door 4 is considerably greater than that when closing.

When closing by means of pressure on the door 4, switch contacts of the safety switching device are closed by the bolt 10 against the action of a compression spring. These indirectly close—e.g. by means of a relay—the operating circuit of the clothes dryer. The safety switching device in this form offers safety advantages, as only low voltage is used in the vicinity of the door.

A very closely toleranced adjustment can be carried out for the switching function depending on the closed position of the door 4 due to the matched size of the bolt 10 and the locking bracket 11 on the door side and the arrangement and switching distance of the contact switch and the locking device on the unit side. The design of the carrier module 8 and the combination module 9, their arrangement and fixing in the manner described mean that the one-off adjustment is maintained permanently.

At the base of the carrier module 8, the bolt 10 and the locking bracket 11 are enlarged conically. On the one hand, this serves to increase the stability of the module 8, but at the same time also to stabilize the bolt 10 and the locking bracket 11 and to provide reliable positioning in relation to the switch and lock seating 13, 18. A changed position of the door 4 therefore has no negative effect on the trouble-free operation of the device according to the invention.

The invention claimed is:

1. A clothes dryer comprising:

a housing having a front wall with a loading opening providing access to a drying space within the housing;

a door for closing the loading opening;

a locking device including a pull-open catch for retaining the door in a closed position, the locking device having a locking bracket and a corresponding cam, which can be rotated into two stable positions;

a safety switching device interrupting the operating voltage for the clothes drier when the door is opened, the safety switching device being functionally separate from the locking device, and the safety switching device having a bolt and a corresponding switch seating with a contact switch; and the bolt and the locking bracket are integrated in a door-side module mounted on the door, the switch seating and the cam being integrated in a housing-side module mounted on the front wall.

2. The clothes dryer as claimed in claim 1, wherein the door-side module includes a reinforced plastic part.

3. The clothes dryer as claimed in claim 1, wherein the door is mounted in a two-part door frame in which recesses for accommodating the door-side module are molded.

4. The clothes dryer as claimed in claim 3, wherein the door-side module is held by means of a press fit in the door frame, the two parts of which are screwed to one another.

5. The clothes dryer as claimed in claim 1, wherein the housing-side module is sized and formed in such a way that it is supported securely in position between an end plate surrounding the door and serving to support a clothes drum arranged inside the housing, and the front wall.

6. The clothes dryer as claimed in claim 5, wherein the mechanically secure seating of the housing-side module is ensured by at least one contour incorporated into the end plate and by projections, which penetrate the end plate and parts of the front wall.

7. The clothes dryer of claim 5, wherein the end plate includes a contour that mechanically secures the housing-side module to the front wall.

8. The clothes dryer of claim 5, wherein the housing-side module includes a projection that penetrates the end plate and parts of the front wall to mechanically secure the housing-side module to the end plate and the front wall.

9. The clothes dryer of claim 5, wherein the housing-side module includes a projection that penetrates the end plate to mechanically secure the housing-side module to the end plate.

10. The clothes dryer of claim 1, wherein the housing-side module includes a projection that penetrates the front wall to mechanically secure the housing-side module to the front wall.

11. A clothes dryer comprising:

a housing having a front wall with a loading opening providing access to a drying space within the housing;

a door for closing the loading opening, the door being attached to the housing by a hinge;

a door-side module mounted on the door opposite a side of the door having the hinge;

a housing-side module mounted on the front wall of the housing on an opposite side of the loading opening from a side of the housing having the hinge;

a locking device including a pull-open catch for retaining the door in a closed position, wherein the locking device includes a locking bracket and a corresponding cam that can be rotated into two stable positions; and a safety switching device that interrupts an operating voltage for the clothes dryer when the door is opened, wherein the safety switching device is functionally separate from the locking device, wherein the safety switching device includes a bolt and a corresponding switch seating with a contact switch, wherein the door-side module includes the locking bracket of the locking device and the bolt of the safety switching device, and wherein the housing-side module includes the cam of the locking device and the switch seating of the safety switching device.

* * * * *